US005797232A

United States Patent [19]

Larson

[11] Patent Number: 5,797,232

[45] Date of Patent: Aug. 25, 1998

[54] GRIPPING PLATE FOR ATTACHING ROOFING MEMBRANE

[75] Inventor: Paul M. Larson, Hoffman Estates, Ill.

[73] Assignee: Illinois Tool Works Inc., Glenview, Ill.

[21] Appl. No.: 689,851

[22] Filed: Aug. 15, 1996

[51] Int. Cl.[6] ..... E04B 5/00

[52] U.S. Cl. ..... 52/408; 52/410; 52/512; 52/506.05; 411/163; 411/164; 411/151; 411/147

[58] Field of Search ..... 52/408, 410, 512, 52/506.05, 506.08, 746.11, 746.1; 411/368, 531, 369, 134, 154, 533, 545, 147, 151, 163, 164

[56] References Cited

U.S. PATENT DOCUMENTS

| | | | |
|---|---|---|---|
| 997,359 | 7/1911 | Ammons | 411/164 |
| 1,267,695 | 5/1918 | Rich, Jr. | 411/163 |
| 1,926,917 | 9/1933 | Rosenberg | 411/163 |
| 2,041,568 | 5/1936 | Olson | 411/164 |
| 2,112,495 | 3/1938 | Olson | 411/163 X |
| 2,559,833 | 7/1951 | Stellin | 411/163 X |
| 3,258,047 | 6/1966 | Loretan | 411/163 X |
| 4,545,270 | 10/1985 | Dewey | 81/429 |
| 4,574,551 | 3/1986 | Giannuzzi | 52/512 |
| 4,751,802 | 6/1988 | Whitman | 52/410 |
| 4,763,456 | 8/1988 | Giannuzzi | 52/410 |
| 4,781,503 | 11/1988 | Bogel | 52/410 X |
| 4,787,188 | 11/1988 | Murphy | 52/410 |
| 4,788,807 | 12/1988 | Whitman | 52/410 |
| 4,799,845 | 1/1989 | Hrysko | 411/542 |
| 4,852,323 | 8/1989 | Kartfilt | 52/410 |
| 4,907,927 | 3/1990 | Choiniere | 411/368 |
| 4,909,691 | 3/1990 | Bogel | 411/531 |
| 5,102,275 | 4/1992 | Hulsey | 411/134 |
| 5,171,116 | 12/1992 | Gerhardt et al. | 52/410 X |
| 5,182,890 | 2/1993 | Peters | 52/410 |

*Primary Examiner*—Carl D. Friedman
*Assistant Examiner*—W. Glenn Edwards
*Attorney, Agent, or Firm*—Schwartz & Weinrieb

[57] ABSTRACT

A gripping element for attaching a roofing membrane to a roof includes a generally planar plate having a generally central opening and an oblong peripheral edge. The plate includes a top surface facing away from the roofing membrane, an upwardly projecting rib, and a plurality of gripping formations for preventing slippage of the roofing membrane relative to the plate. Preferably, the central opening is larger in diameter than the diameter of a corresponding shank portion of a threaded fastener so that the plate is permitted a specified amount of rocking when subjected to a membrane uplift force.

22 Claims, 4 Drawing Sheets

GRIPPING PLATE FOR ATTACHING ROOFING MEMBRANE

FIELD OF THE INVENTION

The present invention relates generally to roofing systems including water resistant membranes, and specifically to plates for securing such roofing membranes to a roof deck.

BACKGROUND OF THE INVENTION

In certain modern roofing installations of commercial and factory buildings having a flat roof design, a layer of insulation is placed on a generally corrugated steel roof deck, and is then covered with a single ply thermoplastic roofing membrane to protect against the elements. The membrane is provided in rolls which are often six feet wide. A common method of securing the roofing membrane to the roof is to attach the edges of a sheet of the membrane to the deck using fasteners passing through the insulation. The most common fastener is an elongated screw passing through a plate or washer. These fastener assemblies, comprising the screw and plate, are placed at regular intervalssuch as, for example, every six inches, along the membrane edge. Once a sheet of roofing membrane is thus secured, another sheet is laid parallel to, and with its edge overlapping, the edge of the already secured sheet. In this manner, the fastened plates are covered by the edge of the second membrane sheet in the overlapped region. Next, a heat gun is used to heat the top and bottom of the overlapping sheets to the melting point, and they are pressed together. As the membrane sheets cool, they become bonded together. This process is continued until the entire roof is covered with the roofing membrane.

It has been found that, because the membrane is exposed to the elements, it may at times be subject to high velocity winds blowing across the roof which cause uplift forces. These forces cause the membrane to billow upwardly. As this occurs, the membrane tends to pull up and exerts an upward force on one edge of the plate, which causes the plate to shift or rock backwards in the direction away from the force. Rocking prevents the fastener from being pulled out of the roof by alleviating this edge-directed force, but it also allows the membrane to slip from underneath the plate, and at a certain point, causes the membrane to tear around the fastener. Rocking also causes the back edge of the plate to press the membrane into the insulation. A disadvantage of conventional plates is that they do not permit sufficient rocking. Consequently, more uplift loading is applied to the screw, which promotes loosening of the screw in the roof deck.

In the event that the plate is round, the load becomes concentrated in a small area, which results in the membrane weakening and tearing at an accelerated pace. Once the membrane tears at one point, the stress on the next adjacent fasteners on each side of the torn point will cause them to tear and fail more rapidly. Eventually the whole sheet will pull away from the roof.

A known plate for securing a roofing membrane to the roof is disclosed in U.S. Pat. No. 4,787,188 to Murphy. Murphy discloses a circular plate having barbs on its lower surface, that is, the surface that faces the membrane closest to the roof deck. The barbs are designed to prevent the membrane from slipping from under the plate. One disadvantage of Murphy's device is that the barbs penetrate into the membrane and damage the reinforcing fibers within the membrane. These punctures tend to cause the membrane to tear. Another disadvantage of the Murphy plate is that it has been found that the circular edge concentrates the load to a small area and tends to weaken and tear the membrane.

Another known plate for securing a roofing membrane is a thin, flat, oblong shaped plate having a supporting ridge following, and set back slightly from, the peripheral edge of the plate. The ridge protrudes from the bottom or lower surface of the plate, which is the side that makes contact with the membrane closest to the roof deck, and is intended to strengthen the plate. A disadvantage of this plate is that it does not prevent membrane slippage, and consequently results in the membrane slipping and tearing around the fastener. Another disadvantage of this type of plate is that, despite the supporting ridge, the plate tends to bend under the pressure and becomes deformed.

OBJECTS OF THE INVENTION

Thus, it is a first object of the present invention to provide an improved plate for attaching a roofing membrane to a roof that distributes the load equally over the plate perimeter so as to prevent concentration of the load on the membrane when the membrane is subject to uplift forces. In this manner, the membrane is protected from tearing.

Another object of the present invention is to provide an improved plate for attaching a roofing membrane to a roof that allows a certain degree of rocking of the plate so as to prevent a fastener from being pried out of the roof.

Yet another object of the present invention is to provide an improved plate for attaching a roofing membrane to a roof which is configured so as to reduce membrane slippage from under the plate so that the membrane does not tear against the fastener.

Still another object of the present invention is to provide an improved roofing membrane attachment plate that is sufficiently strong to resist bending and deformation.

SUMMARY OF THE INVENTION

The above-identified objects are met or exceeded by the present gripping element for attaching a roofing membrane to a roof. In the preferred embodiment, the gripping element is an oblong shaped plate with a rib for adding strength to the plate. Unlike prior plates, the rib of the present plate protrudes from the upper surface of the plate and has a shape that corresponds to, yet is set back from, the peripheral edge of the plate. A gripping formation is also provided on the peripheral plate edge for preventing membrane slippage. An opening is located generally at the center of the plate. The size of the opening is such that the plate is allowed to rock within an optimal angular range when subjected to a membrane uplift force.

More specifically, a gripping element for attaching a roofing membrane to a roof includes a generally planar plate having an opening and a peripheral edge. The peripheral edge of the plate includes a plurality of gripping formations for preventing slippage of the roofing membrane relative to the plate. In addition, the opening is located in a generally planar, central portion of the plate and is sufficiently large in diameter relative to the diameter of a corresponding threaded fastener to permit the above-described rocking of the plate.

Various other objects, features, and attendant advantages of the present invention will be more fully appreciated from the following detailed descripion when considered in connection with the accompanying drawings in which like reference characters designate like or corresponding parts throughout the several views and wherein:

DETAILED DESCRIPTION OF THE ILLUSTRATED EMBODIMENTS

Figure 1:
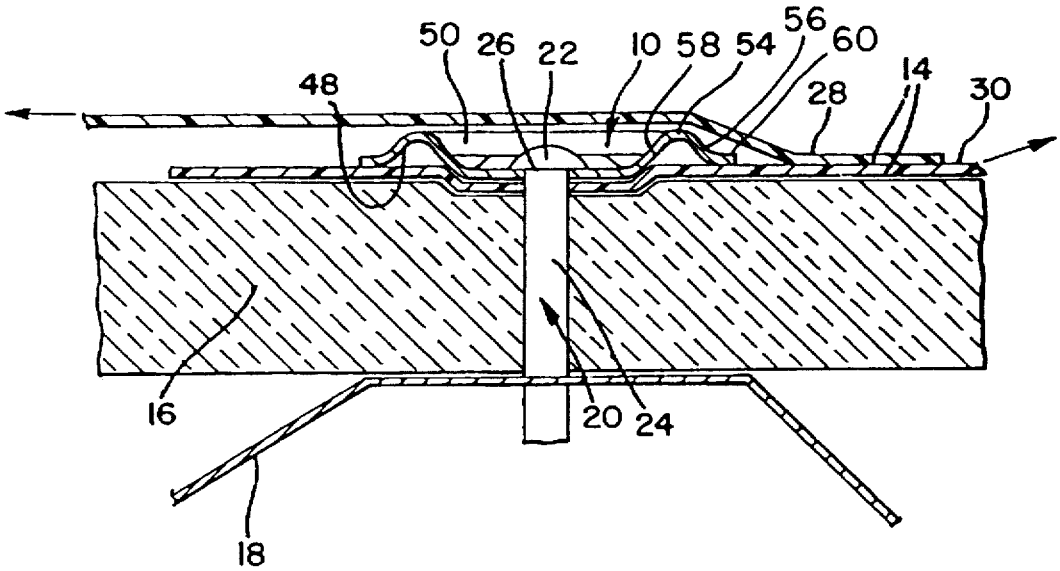
FIG. 1 is a sectional view of the gripping element of the present invention attached to a roof.

Referring now to FIG. 1, a gripping element is shown and generally designated 10. The gripping element 10 is basically a plate which is laid on the top of a thermoplastic roofing membrane 14, which is made of a durable, environmentally resistant material such as PVC, and which is provided in sheet form in rolls having widths from 4 to 10 feet. Beneath the roofing membrane 14 is a layer of insulation 16 which can be any conventional insulation material used in roofing installations, such as polyisocyanurate foam. A support for the insulation 16 is provided by a sheet of roof deck 18, which is preferably 22 gauge steel having a corrugated shape for added strength.

A fastener 20 having a head 22 and a shank 24 secures the plate 10 to the roof deck 18. The fastener 20 is inserted through an opening 26 located generally in the center of the plate 10. It is preferred that the opening 26 has a diameter which is sufficiently greater than the diameter of the shank 24 so that the plate 10 may rock relative to the fastener 20 as described below. Passing through the membrane 14 and the insulation 16, the fastener 20 is hammered or screwed into the roof deck 18, depending on the type of fastener 20 being used, for example, screws or nails. In the preferred embodiment, the fastener 20 is an elongated, sheet metal screw of the self drilling type sold by ITW Buildex, Itasca, Ill., or equivalent.

Installation of the roofing membrane 14 involves laying a top membrane sheet 28 in parallel with a bottom membrane sheet 30, with the edges overlapping by an amount specified by the manufacturer, preferably about 5 to 6 inches. Plates 10 and corresponding fasteners 20 are used to secure the bottom sheet 30 to the roof deck 18 at specified intervals, such as 6, 12 or 18 inches along the edges. Once the bottom membrane sheet 30 is attached to the roof deck 18, the top sheet 28 is pulled over the plate 10, and is welded to the bottom membrane sheet 30 using a heat gun. In this manner, the plate 10 is covered by the top sheet 28 (best seen in FIGS. 1 and 2), thus preventing water from seeping into the insulation 16 through the holes made by the fasteners 20.

Figure 2:
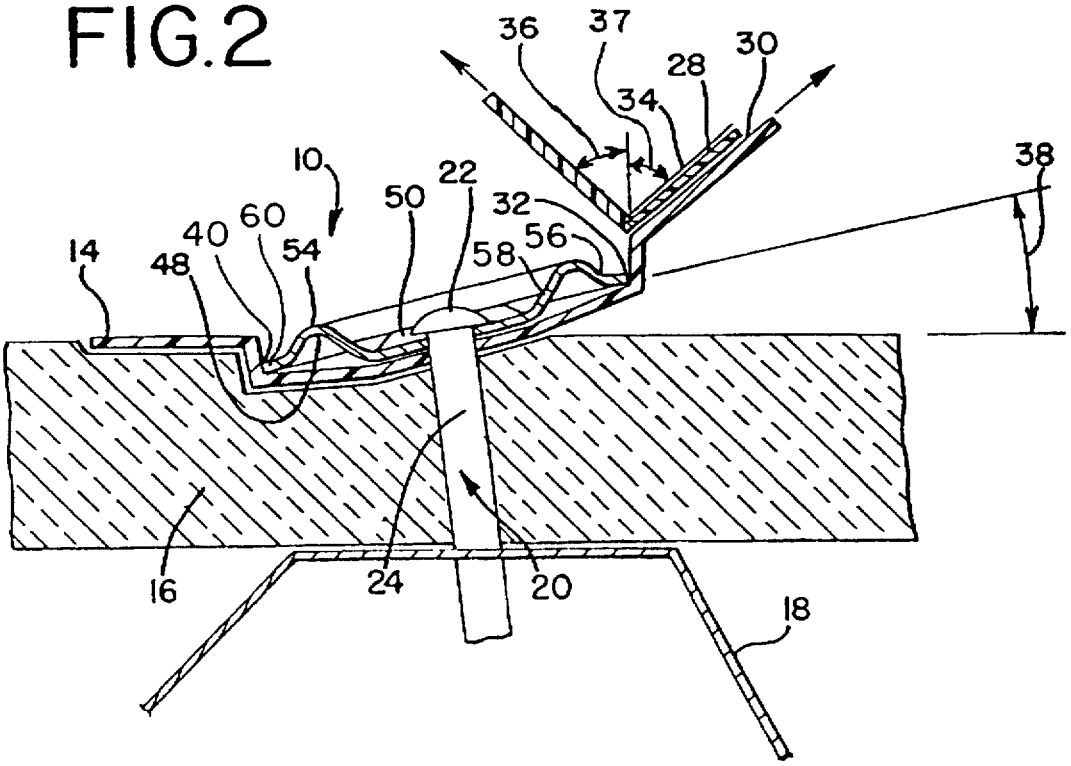
FIG. 2 is a sectional view of the gripping element of the present invention as depicted in FIG. 1 reacting to applied force.

Referring now to FIG. 2, the plate 10 is shown reacting to force being applied thereto by the top and bottom membrane sheets 28, 30, which billow upwardly as negative pressure is created above the roof by ambient wind. The top and bottom membrane sheets 28, 30 are pulled away from each other at equal angles 36, 37 with respect to the horizontal at the point where they are heat welded together. As a result, an edge 32 of the plate 10 near a welded area 34 of the sheets 28, 30 is pulled upwardly in a direction generally normal to the plane of the roof deck 18, and plate 10 is rocked back in a direction away from the welded area 34. The plate 10 is preferably configured so that the degree of rocking is restricted to a maximum of about 30 to 60 degrees from the horizontal, as shown by angle 38 in FIG. 2.

Restricting the rocking to less than about 30 degrees allows uplifted membrane sheets 28, 30 to create a longer moment arm that exerts greater leverage on the plate 10 and the fastener 20. Eventually, these forces cause the fastener 20 to bend, loosen and/or eventually disengage from the roof deck 18. Restricted rocking also exerts more stress on the underside of the head 22, which has the tendency to pop-off the fastener head 22. On the other hand, if the plate 10 is allowed to rock beyond 60 degrees, the portion of the membrane pulling force that acts to pull the membrane 30 past the plate 10, which is a function of the angle of the plate 38, increases to a point where it cannot be countered by the gripping longer side edge 40 of the plate 10 opposite the welded areas 34. Thus, the membrane 30 slips past the plate 10. By permitting the plate 10 to rock within the desired angular range, the pressure exerted on the fastener 20 is alleviated, and the membrane 30 is prevented from slipping past the plate 10.

Figure 5:
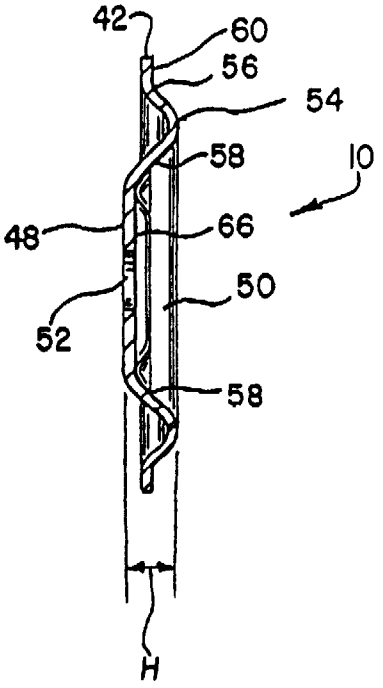
FIG. 5 is a sectional view taken along the line 5—5 in FIG. 3 and in the direction indicated generally.
Figure 3:
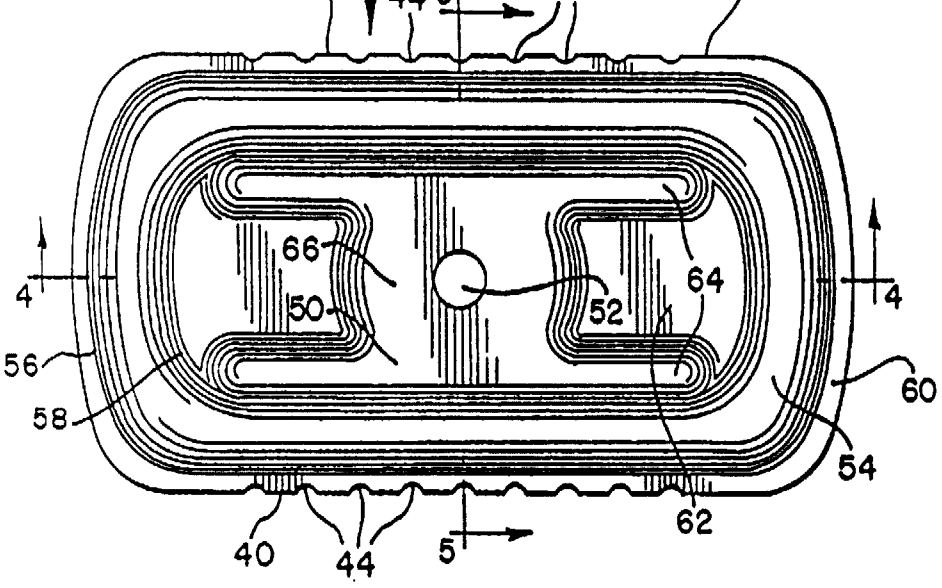
FIG. 3 is a top view of the present gripping element.
Figure 4:
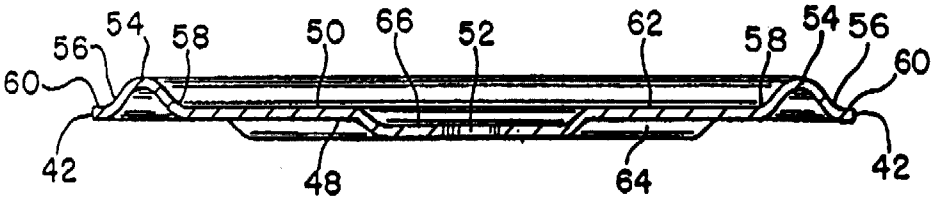
FIG. 4 is a sectional view taken along the line 4—4 in FIG. 3 and in the direction indicated generally.

Referring now to FIGS. 3, 4 and 5, the gripping element 10 is basically a generally planar plate having an oblong peripheral edge 42. The plate 10 may be stamped from flat metal or it may be injection molded of suitably rigid and durable polymeric material such as nylon, as shown, for example, in FIGS. 6–8. In the preferred embodiment, the peripheral edge 42 includes a plurality of notches 44 spaced apart along the longer two sides 40. The notches 44 are configured to increase friction between each side edge 40 and the membrane 14 so as to prevent the membrane 14 from slipping relative to the plate 10. Accordingly, the notches 44 should be sufficiently deep to create friction required to prevent slippage, but not so deep as to cause tears in the membrane 14. In the preferred embodiment, the notches are approximately 0.015 inch deep. It is contemplated that the orientation, number, shape, depth and spacing of the notches 44 may vary with the application, including, for example, file-like grooves arranged in parallel or checkered patterns.

Also provided upon the plate 10 is a bottom surface 48 and a top surface 50. Upon installation, the bottom surface 48 is disposed toward the bottom membrane sheet 30 and the top surface 50 faces away from the bottom membrane sheet 30 as best seen in FIGS. 1 and 2.

An opening 52 is generally centrally located on the plate 10 for receiving the fastener 20. The opening 52 and the fastener 20 determine the amount of rocking the gripping element 10 is allowed, and therefore, the dimension of the opening 52 should generally correspond to that of the fastener 20. For example, with a fastener 20 having a shank diameter of approximately 0.203" and a head diameter of 0.440", an opening 52 of 0.270" is preferred to provide the optimal degree of rocking, that is, within a maximum range of 30° to 60°. Rocking can also be accommodated with the use of ribs or bumps (not shown) on the bottom of either side of the head 22.

A rib 54 is located on the plate 10 between the peripheral edge 42 and the opening 52. When viewed from the top, the rib 54 defines an outer and an inner perimeter 56, 58, which generally correspond to the peripheral edge 42, as best seen in FIG. 3. The rib 54 protrudes upwardly from the top surface 50 so that it is broadly convex when viewed from above and concave when viewed from the bottom, as best seen in FIGS. 4 and 5. When force is exerted by the membrane 14, the rib 54 provides added strength to the plate 10, so as to prevent it from bending and deforming. As such, the rib 54 is configured for providing maximum support to the plate 10.

The outer perimeter 56 of the rib 54 defines a lip 60 that extends from the outer perimeter 56 to the peripheral edge 42 of the plate 10. When the plate 10 is attached to the membrane 14, the bottom of the lip 60 rests flush on the membrane 14 as best seen in FIGS. 1 and 2. An inner base 62 is defined by the inner perimeter 58 and includes two parallel grooves 64. Each groove 64 is located between the opening 52 and the inner perimeter 58, and extends substantially the length of the straight portion of the inner perimeter 58 as best seen in FIG. 3. Both grooves 64 protrude downwardly from the bottom surface 48 of the plate 10 so that they appear convex when viewed from the bottom, and appear as a pair of parallel grooves when viewed from the top.

Also provided upon the inner base 62 is a generally planar, circular depressed seat portion 66 that is generally concentric with the opening 52. The seat portion 66 protrudes downwardly from the bottom surface 48 between the grooves 64 and connects the two grooves 64. The surface of the seat portion 66 is generally planar, as best seen in FIG. 4, so as to allow head 22 of the fastener 20 to rest evenly thereon. It will be evident from FIGS. 4 and 5 that the planar seat portion 66 is the lowest point on the plate 10, and that the top of the rib 54 is the highest point on the plate 10. It is preferred that the distance between the highest and lowest points, indicated at "H", as best seen in FIG. 5, is maximixed compared to conventional plates so as to provide additional strength to the plate 10, and to accommodate the preferred range of rocking. In the preferred embodiment, the distance H is on the order of 0.250 inch, however other sizes are contemplated depending on the application.

While an embodiment has been described above in which the gripping plate 10 is formed from metal, according to another embodiment of the present invention, the gripping element is formed from plastic. It should be understood that the plastic gripping element of the present invention meets or exceeds the above-identified objects equally as well as the gripping element formed from metal. However, because of the differences in the properties of plastic and metal, the configuration of the plastic gripping element is modified accordingly.

Figure 8:
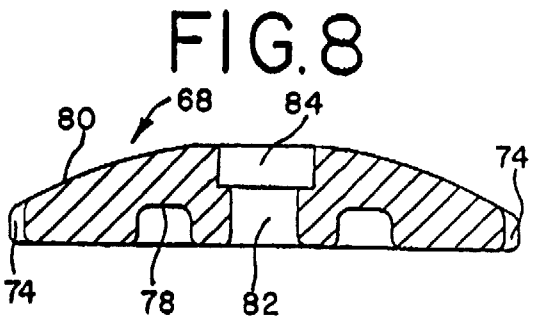
FIG. 8 is a sectional view taken along the line 8—8 in FIG. 6 in the direction indicated generally.
Figure 6:
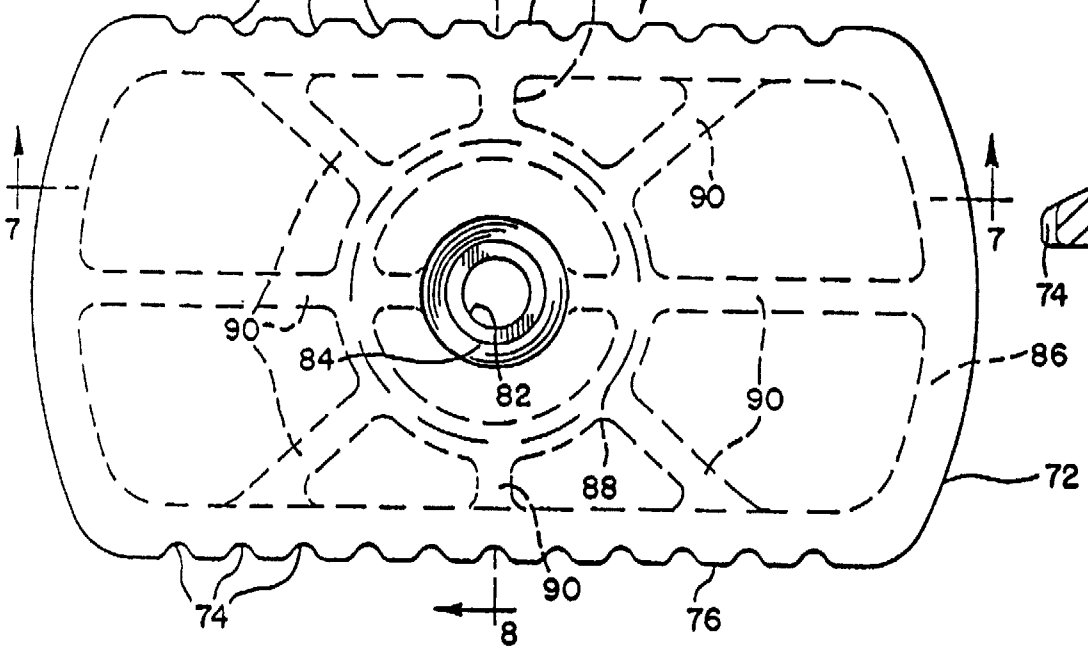
FIG. 6 is a top view of another embodiment of the present invention.
Figure 7:
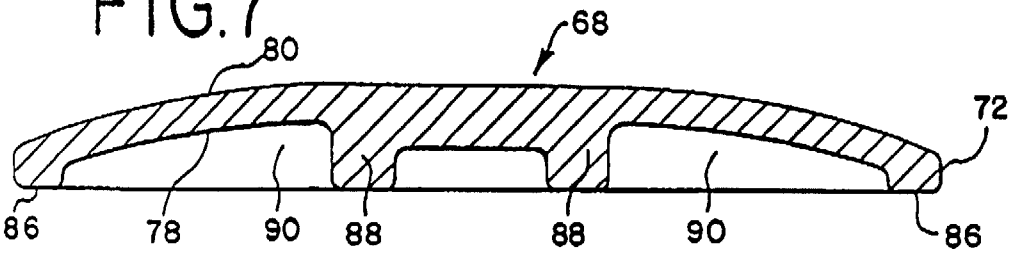
FIG. 7 is a sectional view taken along the line 7—7 in FIG. 6 in the direction indicated generally.

Referring now to FIGS. 6, 7 and 8, a gripping element formed from plastic is shown and generally designated 68. The gripping element 68 is basically a generally planar plate having an oblong peripheral edge 72. In the preferred embodiment, the peripheral edge 72 includes indentations 74 that are spaced apart equally along the longer two sides 76. Alternatively, the indentations 74 may also be in the form of bumps (not shown) attached to the sides 76. The indentations 74, as do the notches 44 on the metal gripping element 10, prevent the membrane 14 from slipping relative to the plate 68.

Also provided on the plate 68 is a bottom surface 78 and a top surface 80. Upon installation, the bottom surface 78 is disposed toward the bottom membrane sheet 30 and the top surface 80 faces away from the bottom membrane sheet 14. When viewed from above, the top surface 80 is broadly convex.

An opening 82 is generally centrally located on the plate 68. Also located on the plate 68 is a counterbore 84, which is concentric with the opening 82. In the preferred embodiment, the diameter of the counterbore 84 is greater than that of the opening 82. In this manner, the head 22 of the fastener 20 rests within the counterbore 84 and the shank 24 passes through the opening 82 to the roof deck 18.

Depending from the top surface 80 of the plate 68, and following the peripheral edge 72 is a frame 86. An arcuate, strengthening rib 88 also depends from the top surface 80 and is located concentrically about the axis of the opening 82. Eight generally equally spaced apart radial ribs 90 extend from the arcuate rib 88 to the frame 86 as best seen in FIG. 6. The frame 86, the arcuate rib 88 and the radial ribs 90 depend from the top surface 80 a substantially equal distance so that when the plate 68 is placed on the membrane 14, it is generally planar as best seen in FIGS. 7 and 8. The configuration of these ribs 90 allow the center shank retaining portion 92 to rock independently of the arcuate and the radial ribs 88, 90, when one side 76 of the plate 68 is pulled upwards by the membrane 14.

Figure 9:
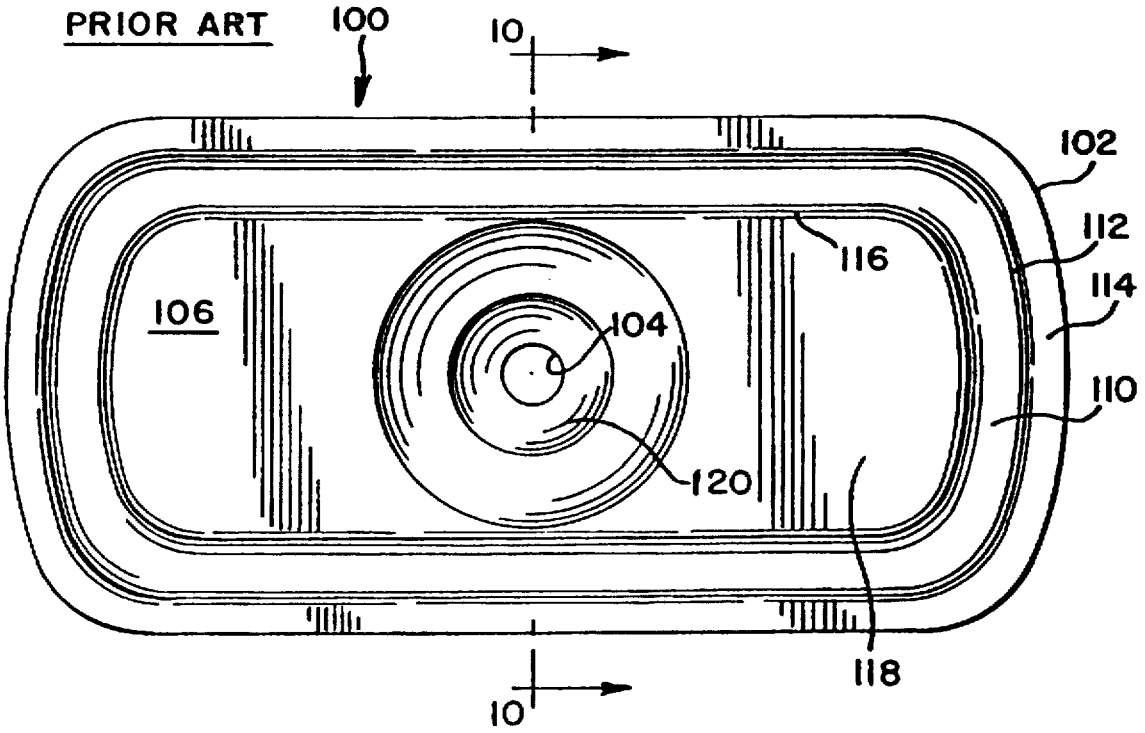
FIG.9 PRIOR ART
FIG. 9 is a top view of a prior art gripping element.
Figure 10:
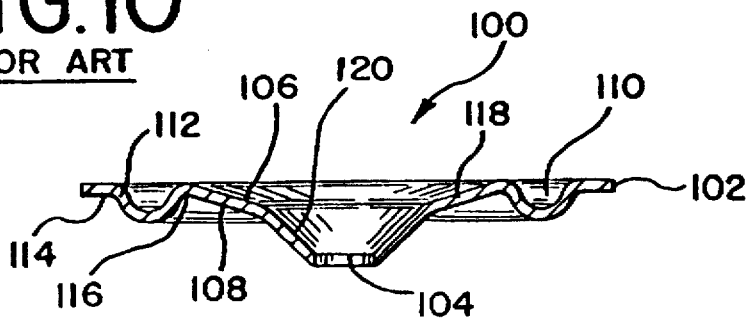
FIG.10 PRIOR ART
FIG. 10 is a sectional view taken along the line 10—10 of FIG. 9 and in the direction indicated generally.

Referring now to FIGS. 9 and 10, a prior art gripping element is generally designated 100. The gripping element 100 is metal stamped to form a generally planar plate having an oblong peripheral edge 102, and a generally central opening 104 which accommodates a fastener similar to the fastener 20. The plate 100 has a top surface 106 and a bottom surface 108, the latter engaging the membrane 14. Located between the peripheral edge 102 and the opening 104 is a generally oblong groove 110 which generally corresponds to, and is set back from, the peripheral edge 102. An outer edge 112 of the groove 110 defines a peripheral lip 114. An inner edge 116 of the groove 110 defines a generally planar interior portion 118. Circumscribing the opening 104 is a generally inclined countersunk portion 120 configured for accommodating the head of the fastener 20.

Although the plate 100 accommodates wind-generated forces to a greater extent than prior art disk-like plates, it has been found that forces acting on one or more of the comers of the peripheral edge 102 often cause those comers to bend upwardly. The resulting shape is a generally triangular plate, with a point which tends to tear the membrane 14. In addition, the plate 100 is ineffectual in preventing slippage of the membrane relative to the plate 100. While it is not known specifically why the plate 100 is unsatisfactory, or why the plate 10 is far stronger than former plates, it will be seen that the groove 110 projects downwardly and into the membrane and insulation, while the rib 54 of the present plate 10 projects upwardly, apparently providing more resistance against wind-generated pulling forces. Among other things, this feature of the plate 10 increases its rigidity and resistance to wind-generated forces.

It will be appreciated that a significant advantage of the present gripping element is that it has an oblong shape which distributes the load equally along its sides so that the membrane will not tear. Another major advantage of this invention is that the gripping element is allowed to rock within a particular angular range so as to prevent the fastener from being pried or pulled out of the roof. Yet another advantage of this invention is that the sides have gripping formations which prevent the membrane from slipping relative to the gripping element. Still another advantage of this invention is that the ribs protrude upwardly, thereby providing increasing strength to the gripping element so as to resist bending and deformation.

While various embodiments of the gripping element of the invention have been shown and described, it will be appreciated by those skilled in the art that changes and modifications may be made thereto without departing from the invention in its broader aspects and as set forth in the following claims.

What is claimed is:

1. A gripping element for attaching a roofing membrane to a roof, comprising:

a substantially planar, rigid plate having an opening, defined within a substantially central portion of said substantially planar plate, for receiving a fastener for securing said gripping element to a roof, and a rigid, non-bendable peripheral region having an outermost peripheral edge portion;

said rigid, non-bendable peripheral region having a plurality of gripping formations formed within said outermost peripheral edge portion thereof for engaging the roofing membrane and preventing slippage of the roofing membrane relative to said plate.

2. The gripping element as defined in claim 1, wherein:

said substantially planar, rigid plate has a substantially oblong configuration.

3. The gripping element as defined in claim 1, wherein:

said substantially planar plate comprises a top surface and a bottom surface, and a rib interposed between said outermost peripheral edge and said substantially central opening, said rib being configured so as to project upwardly from said top surface.

4. The gripping element as defined in claim 3, wherein;

said rib has a configuration that substantially corresponds to that of said outermost peripheral edge.

5. The gripping element as defined in claim 4 wherein said rib defines a lip which extends from said rib to said outermost peripheral edge.

6. The gripping element as defined in claim 4, wherein:

said rib defines an inner base portion which is substantially coplanar with said outermost peripheral edge of said substantially planar plate.

7. The gripping element as defined in claim 6, wherein:

said rib comprises an inner perimeter portion and an outer perimeter portion; and said inner base portion comprises a pair of substantially parallel grooves located between said inner perimeter portion of said rib and said substantially central opening.

8. The gripping element as defined in claim 7, wherein:

said inner base portion further comprises a substantially planar, circular, depressed seat portion located between said pair of grooves and generally concentric with said substantially central opening.

9. The gripping element as defined in claim 1 wherein said gripping formations are a plurality of notches cut into said outermost peripheral edge.

10. The gripping element as defined in claim 1, wherein:

said substantially central opening is located on said substantially planar plate in a substantially planar portion which is vertically depressed relative to said outermost peripheral edge.

11. The gripping element as defined in claim 10, wherein:

said substantially central opening is dimensioned for accommodating a shank portion of the fastener having a predetermined shank diameter, wherein said substantially central opening has a diametrical extent which is greater than the predetermined shank diameter of the fastener so as to permit rocking of said plate relative to the fastener.

12. The gripping element as defined in claim 1, wherein:

said substantially planar plate includes a counter-bore which is substantially concentric with said substantially central opening, said counterbore having a diameter that is greater than the diameter of said substantially central opening.

13. The gripping element as defined in claim 1, wherein:

said substantially planar plate includes a frame disposed along said rigid, non-bendable peripheral region wherein said frame depends from a top surface of said substantially planar plate.

14. The gripping element as defined in claim 13, wherein:

said substantially planar plate includes a substantially circular rib located between said frame and said substantially central opening, wherein said substantially circular rib is substantially concentric about an axis of said substantially central opening and depends from said top surface of said substantially planar plate.

15. The gripping element as defined in claim 14, wherein:

said substantially planar plate includes a plurality of radial ribs which are substantially equally spaced apart in a circumferential direction, which extend from said substantially circular rib to said frame, and which depend from said top surface of said substantially planar plate.

16. A gripping assembly for attaching a roofing membrane over an insulating material and onto a roof, comprising:

a substantially planar, rigid plate having an oblong configuration and comprising a rigid, non-bendable peripheral region having an outermost peripheral edge portion which has a plurality of gripping formations formed thereon for engaging the roofing membrane and preventing slippage of the roofing membrane relative to said substantially planar, rigid plate, and further comprising a top surface, and a bottom surface, whereupon installation to the roof, said top surface is disposed away from the roofing membrane and the bottom surface is disposed toward the roofing membrane;

said substantially planar, rigid plate further including a rib having an oblong configuration corresponding to that of said peripheral edge, said rib projecting upwardly from said top surface of said substantially planar, rigid plate, and said rib defining an inner base portion; and a fastening element, including a head portion and a shank portion having a predetermined diameter, for securing said substantially planar, rigid plate to the roof;

said inner base portion of said substantially planar, rigid plate having an opening having a predetermined diameter for receiving said shank portion of said fastening element, wherein said predetermined diameter of said opening of said inner base portion of said substantially planar, rigid plate is greater than said predetermined diameter of said shank portion of said fastener so as to allow said substantially planar, rigid plate to rock within an optimal angular range with respect to the insulating material and the roof when a force is exerted upon said substantially planar, rigid plate by the roofing membrane.

17. The gripping assembly as defined in claim 16 wherein said optimal angular range is 30° to 60° with respect to the roofing membrane.

18. A gripping element for attaching a roofing membrane to a roof, comprising:

a substantially planar, rigid plate;

an opening, defining an axis therethrough, defined within a substantially central portion of said substantially planar, rigid plate for receiving a fastener for securing said gripping element to a roof; and a rigid, non-bendable peripheral edge portion defined about said substantially planar, rigid plate and having a plurality of substantially radially outwardly extending gripping formations formed thereon for engaging the roofing membrane and preventing slippage of the roofing membrane relative to said substantially planar, rigid plate.

19. The gripping element as set forth in claim 18, wherein:

said substantially planar plate has a substantially oblong configuration comprising a pair of relatively long, oppositely disposed sides, and a pair of relatively short, oppositely disposed ends; and said plurality of gripping formations are disposed along said pair of relatively long oppositely disposed sides.

20. A gripping element for attaching a roofing membrane to a roof, comprising:

a substantially planar, rigid plate having a substantially oblong configuration comprising a pair of relatively long, oppositely disposed sides, and a pair of relatively short, oppositely disposed ends;

an opening, defining an axis therethrough, defined within a substantially central portion of said substantially planar, rigid plate for receiving a fastener for securing said gripping element to a roof;

a rigid, non-bendable peripheral region, having an outermost peripheral edge portion, defined upon said substantially planar, rigid plate so as to extend along said pair of relatively long, oppositely disposed sides and said pair of relatively short, oppositely disposed ends; and a plurality of gripping formations, formed upon said outermost peripheral edge portion and extending along said pair of relatively long, oppositely disposed sides of said substantially planar, rigid plate, for engaging the roofing membrane, preventing slippage of the roofing membrane relative to said substantially planar, rigid plate, and for distributing the stresses of the roofing membrane, when the roofing membrane experiences uplifting forces, over a relatively large area.

21. A gripping element for attaching a roofing membrane to a roof, comprising:

a substantially planar, rigid plate;

a rigid, non-bendable peripheral region, having an outermost peripheral edge portion, defined upon said substantially planar, rigid plate;

a plurality of gripping formations formed upon said outermost peripheral edge portion of said substantially planar, rigid plate for engaging the roofing membrane and preventing slippage of the roofing membrane relative to said substantially planar, rigid plate; and an opening, defined within a substantially central portion of said substantially planar, rigid plate, for receiving a shank portion of a fastener for securing said gripping element to a roof, wherein said opening has a predetermined diameter which is greater than the diameter of the shank portion of the fastener so as to permit said substantially planar, rigid plate to rock within an optimal angular range with respect to the roof when a force is exerted upon said substantially planar, rigid plate by the roofing membrane.

22. The gripping element as set forth in claim 21, wherein:

said optimal angular range is 30° to 60° with respect to the roofing membrane.

* * * * *